US009470496B2

(12) United States Patent
Kokinis et al.

(10) Patent No.: US 9,470,496 B2
(45) Date of Patent: Oct. 18, 2016

(54) DISINTEGRATING AMMUNITION BELT LINK

(71) Applicant: MACHINEGUNARMORY, LLC, Sandy, UT (US)

(72) Inventors: John Kokinis, Sandy, UT (US); Paul Taylor, Taylorsville, UT (US); Austin Lockey, Midvale, UT (US); Paul Gettings, Sandy, UT (US)

(73) Assignee: MACHINEGUNARMORY, LLC, Sandy, UT (US)

( * ) Notice: Subject to any disclaimer, the term of this patent is extended or adjusted under 35 U.S.C. 154(b) by 0 days.

(21) Appl. No.: 14/595,291

(22) Filed: Jan. 13, 2015

(65) Prior Publication Data

US 2016/0202032 A1 Jul. 14, 2016

(51) Int. Cl.
*F42B 39/08* (2006.01)

(52) U.S. Cl.
CPC ..... *F42B 39/08* (2013.01)

(58) Field of Classification Search
CPC ..... F42B 39/08
USPC ..... 89/35.01, 35.02, 33.25
See application file for complete search history.

(56) References Cited

U.S. PATENT DOCUMENTS 1,315,742 A * 9/1919 Prideaux ..... 89/35.01
2,173,837 A * 9/1939 Gorton ..... 89/35.02
2,352,954 A * 7/1944 Higson ..... 89/35.02
2,472,817 A * 6/1949 Gaidos ..... 89/35.02
3,229,584 A * 1/1966 Zehuder ..... 89/33.25
3,650,176 A * 3/1972 Lindner ..... 89/35.02

OTHER PUBLICATIONS

Load Data; https://www.loaddata.com/members/search_detail.cfm?MetallicID=4399.*
Website screen capture, "ARES-16 Belt-Fed AMG-2 in 6.8 SPC." ARESDefense, website: https://www.youtube.com/watch?v=C5Gfho2qtwY; printed Dec. 2014, 2 pages.
YouTube Video, "ARES-16 Belt-Fed AMG-2 in 6.8 SPC." ARESDefense, published Oct. 2012, https://www.youtube.com/watch?v=C5Gfho2qtwY (7 pages); video frame capture at 0:00 and 0:07—p. 1; video frame capture at 0:09 and 0:10—p. 2; video frame capture at 0:11 and 0:13—p. 3; video frame capture at 0:20 and 0:26—p. 4; video frame capture at 0:34 and 0:36—p. 5; video frame capture at 0:41 and 0:46—p. 6; transcript of audio—p. 7.
"Maximum Cartridge/Minimum Chamber: 6.8mm Remington SPC." Sporting Arms and Ammunition Manufacturers' Institute, Inc., published and available, on information and belief, at least as early as Jan. 10, 2014 (1 page); available at: http://www.saami.org/pubresources/cc_drawings/Rifle/6_8mm%20Remington%20SPC.pdf.

(Continued)

*Primary Examiner* — Reginald Tillman, Jr.
(74) *Attorney, Agent, or Firm* — Workman Nydegger

(57) ABSTRACT

A plurality of ammunition links form a belt of ammunition by interlocking with a plurality of tapered rounds having average casing diameters between about 0.400 inches and about 0.425 inches. A link includes at least a first resilient member and a second resilient member that extend in substantially opposing directions. A link engages with and provides a compressive force to a first round with the first resilient member and, optionally, a third resilient member. The link engages a second round and applies less or substantially no compressive force with the second resilient member.

39 Claims, 7 Drawing Sheets

(56) References Cited

OTHER PUBLICATIONS

Website forum discussion, "Nice Write-Up on 6.8 in Special Weapons for Military & Police Dec. 2009 issue." 68Forums.com, posted Dec. 2009, 50 pages, printed Dec. 2014.
Website forum discussion, "6.5 Grendel vs. 6.8 SPC vs. .308." PredatorMastersForums.com, posted Jul. 2012, 15 pages, printed Dec. 2014.
Website article, "6.5 Grendel Versus 6.8 SPC." Tactical-Life.com, posted Dec. 2009, 2 pages, printed Dec. 2014.
"Nice Write-Up on 6.8 in Special Weapons for Military & Police," from 68forums.com, Dec. 2009 issue, 8 pages.
6.88mm M249? [Archive], from 68forums.com, printed Dec. 8, 2004, 5 pages.
JPEG pages of 5.56 mm M27 ammunition belt link specifications "Link, Cartridge, Metallic Belt, 5.56 mm M27," dated Sep. 17, 2003, published, on information and belief, at least as early as May 2014, 2 JPEG pages on disc.
JPEG page of M13 ammunition belt link specifications, published, on information and belief, at least as early as May, 2014, 1 JPEG page on disc; and one page (hard copy) Turkish to English translation (translating Turkish word "kalinlik" to English word "thickness"). 1 page.
PDF pages of 5.56 mm M27 ammunition belt link specifications "Link, Cartridge, Metallic Belt, 5.56 mm M27," dated Sep. 17, 2003, published, on information and belief, at least as early as May 2014, 2 PDF pages.
Shea, D. MGA's Semiautomatic MK46 Variant. Small Arms Review, 13(4), pp. 48-54, Chipotle Publishing, USA, published, on information and belief, at least as early as Jan. 2010, 7 pages.
PDF page of M13 ammunition belt link specifications, published, on information and belief, at least as early as May, 2014, 1 PDF page; and one page Turkish to English translation (translating Turkish word "kalinlik" to English word "thickness"), 1 page.
Video on disc, "ARES-16 Belt-Fed AMG-2 in 6.8 SPC", published, on information and belief, at least as early as Oct. 2012.

* cited by examiner

DISINTEGRATING AMMUNITION BELT LINK

BACKGROUND

Semi-automatic and fully-automatic firearms may be designed to automatically expel the cartridge of a fired round of ammunition and chamber a new round of ammunition without the intervention of an operator. Such self-feeding of ammunition to a firearm is used to provide high rates of fire through both semi-automatic and fully-automatic firearms. The self-feeding operation may be performed by the internal operating group of the firearm using a variety of mechanism. A firearm may use the expanding gas from the fired round and/or the recoil from the fired round to provide energy to feed a new round of ammunition into the firearm.

In a closed-bolt firearm, a cycle of the firearm may include moving a firing pin to detonate a round in a chamber, retracting a bolt from the chamber, removing the casing of the fired round from the chamber, ejecting the casing of the fired round from the firearm, advancing a new round into alignment with the chamber, chambering the new round and closing securing the bolt to chamber the round. In an open-bolt firearm, a cycle of the firearm may include moving a bolt and firing pin forward, striking a round of ammunition, moving the bolt away from the chamber, removing the casing of the fired round from the chamber, ejecting the casing of the fired round from the firearm, and advancing a new round into alignment with the chamber. In both closed-bolt and open-bolt firearms, a cycle of the firearm includes advancing the next round into alignment with the chamber.

Each subsequent round may be moved into alignment with the chamber from a feed system. In some feed systems, each subsequent round is advanced by a mechanism independent of a cycle of the firearm. For example, a round may be moved from a storage position into alignment with the chamber by a mechanism in the ammunition storage device, such as in a magazine. In a magazine, multiple rounds of ammunition are stored with a follower at one end of the magazine. The follower may be a spring-loaded follower, or may include another mechanism to urge the rounds towards the chamber. A firearm using a magazine may passively have each subsequent round provided to the firearm such as in a semi-automatic handgun.

In other feed systems, each subsequent round is moved into alignment with the chamber by an operation of the firearm during each cycle. For example, a firearm including a clip may move each subsequent round from the clip to alignment with the chamber without an advancement mechanism in the clip. The entire clip and associated ammunition may move relative to a body of the firearm via an actuation mechanism of the firearm. The energy to move each round of the ammunition and/or move the clip may be provided by the firing of the gun, such as in a gas operated or gas-piston operated firearm, or by other sources, such as an electric motor. In a firearm that advances each subsequent round of ammunition by harnessing some of the energy of the firing of the gun, improper feeding of a round and/or improper removal of a round from the clip or magazine may lead to a jamming of the firearm. Jamming of the firearm may render the firearm temporarily unusable. In some situations, an unusable firearm may place at least the operator at risk.

SUMMARY

The following summary is provided to introduce a selection of concepts that are further described below in the detailed description. This summary is not intended to identify specific features of the claimed subject matter, nor is it intended to be used as an aid in limiting the scope of the claimed subject matter.

A link of the present disclosure includes a body and a first resilient member and a second resilient member. The first resilient member extends laterally from the body in a first direction in a first arc. The first arc is normal to a first longitudinal axis and defines a first circumference around which the first resilient member extends more than halfway. The second resilient member extends laterally from the body in a second direction that is substantially opposite the first direction. The second resilient member extends in a second arc and the second arc is normal to a second longitudinal axis. The second arc defines a second circumference around which the second resilient member extends more than halfway. The second longitudinal axis is parallel to the first longitudinal axis. A retention member extends in a third direction, the third direction being substantially perpendicular to both the first direction and second direction. The first arc has a first diameter between about 0.390 inches and about 0.425 inches and the second arc has a second diameter between about 0.400 inches and about 0.435 inches.

In another embodiment, a link includes a body and a first resilient member, a second resilient member, and a third resilient member. The first resilient member extends laterally from the body in a first direction in a first arc. The first arc is normal to a first longitudinal axis and defines a first circumference around which the first resilient member extends more than halfway. The second resilient member extends laterally from the body in a second direction that is substantially opposite the first direction. The second resilient member extends in a second arc and the second arc is normal to a second longitudinal axis. The second arc defines a second circumference around which the second resilient member extends more than halfway. The second longitudinal axis is parallel to the first longitudinal axis. The third resilient member extends laterally from the body in the first direction in a third arc. The third arc is normal to a first longitudinal axis and defines a third circumference around which the third resilient member extends more than halfway. A retention member extends in a third direction, the third direction being substantially perpendicular to both the first direction and second direction. The first arc has a first diameter between about 0.390 inches and about 0.425 inches, the second arc has a second diameter between about 0.400 inches and about 0.435 inches, and the third arc has a third diameter between about 0.390 inches and about 0.425 inches.

A linking system includes a plurality of links. Each link of the plurality of link includes a body and a first resilient member and a second resilient member. The first resilient member extends laterally from the body in a first direction in a first arc. The first arc is normal to a first longitudinal axis and defines a first circumference around which the first resilient member extends more than halfway. The second resilient member extends laterally from the body in a second direction that is substantially opposite the first direction. The second resilient member extends in a second arc and the second arc is normal to a second longitudinal axis. The second arc defines a second circumference around which the second resilient member extends more than halfway. The second longitudinal axis is parallel to the first longitudinal axis. A retention member extends in a third direction, the third direction being substantially perpendicular to both the first direction and second direction. The first arc has a first diameter between about 0.390 inches and about 0.425 inches and the second arc has a second diameter between about 0.400 inches and about 0.435 inches. The linking system also includes one or more cylindrical casings. At least one of the one or more cylindrical casings has a first resilient member engaged around a majority of a circumference thereof and a second resilient member engaged around a majority of a circumference thereof. The first resilient member applies a compressive force to the casing and the second resilient member applies no compressive force.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

The following description relates generally to the storage and delivery of ammunition to a self-feeding firearm. The following description describes various embodiments of device, systems and methods of storage and delivery of ammunition to a self-feeding firearm. The described embodiments should be understood to illustrate one or more features of the present disclosure and should not be understood to be limiting embodiments. One or more features disclosed in relation to any embodiment described herein may be freely combined with one or more features of any other embodiment or embodiments described herein.

A firearm clip may be flexible such that each round of ammunition may move in at least one degree of freedom relative to one another. A plurality of rounds may be held together in a belt. An ammunition belt comprises a plurality of links, each of which comprise at least two resilient members. At least one of the resilient members is configured to connect a first link to a first round and at least one other resilient member is configured to connect the first link to a second round. A second link includes at least one resilient member that connects the second link to the second round and at least one other resilient member that connects the second link to a third round. The first and second links may be substantially similar or, in some embodiments, identical such that a belt of ammunition may include a plurality of substantially similar links connected to substantially similar rounds. The belt may include any number of links and/or rounds.

Figure 1:
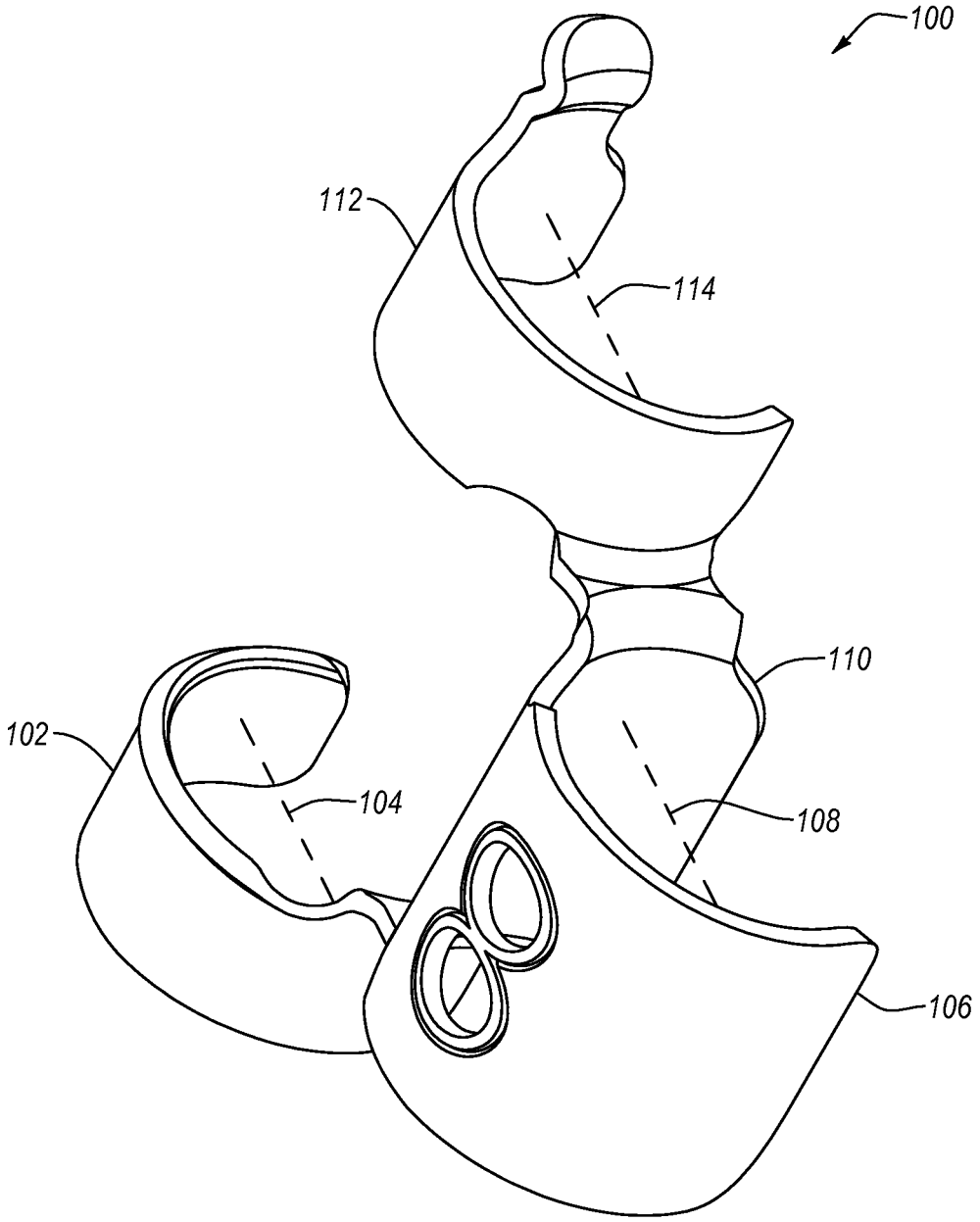
FIG. 1 is a perspective view of a link.

As shown in FIG. 1, in some embodiments, a link 100 is configured to limit relative movement of the link and a cylindrical casing having an outer diameter that is constant along a length of the cylindrical casing. In other embodiments, the links may be configured to limit relative movement of the link and a cylindrical casing having an outer diameter that varies along the length of the cylindrical casing. The cylindrical casing has an outer diameter in range having upper and lower values including about 0.390 inches, 0.395 inches, 0.400 inches, 0.405 inches, 0.410 inches, 0.415 inches, 0.420 inches, about 0.425 inches, or any value therebetween. For example, the links may be configured to substantially retain a cylindrical casing having an outer diameter between about 0.400 inches and about 0.420 inches. In another example, the links may be configured to substantially retain a cylindrical casing having an average outer diameter of about 0.410 inches. In at least one embodiment, the link 100 may be configured to substantially retain a round of 6.8 mm SPC Remington rifle ammunition. In another embodiment, the link 100 may be configured to substantially retain a round of 7.62×39 mm rifle ammunition. In yet another embodiment, the link 100 may be configured to substantially retain a round of 6.8 mm SPC Remington rifle ammunition or 7.62×39 mm rifle ammunition. The link 100 or a plurality of links 100 are also highly useful because the links 100 can hold both tapered and non-tapered ammunition making the links 100 a valuable contribution to the art.

A link 100 includes a first resilient member 102 that has a first inner diameter 104 and a second resilient member 106 that has a second inner diameter 108. In some embodiments, the first inner diameter 104 and second inner diameter 108 may be the same. In other embodiments, the first inner diameter 104 and second inner diameter 108 may be different. For example, the first inner diameter 104 may be larger than the second inner diameter 108. In the depicted embodiment, the second inner diameter 108 is larger than the first inner diameter 104. The first inner diameter 104 is within a range having upper and lower values including about 0.370 inches, 0.375 inches, 0.380 inches, 0.385 inches, 0.390 inches, 0.395 inches, 0.400 inches, 0.405 inches, 0.410 inches, 0.415 inches, 0.420 inches, about 0.425 inches, or any value therebetween. For example, the first inner diameter 104 may be between about 0.375 inches and about 0.410 inches. In another example, the first inner diameter 104 may be between about 0.380 and about 0.400 inches. In yet another example, the first inner diameter 104 may be about 0.399 inches.

The second inner diameter 108 is within a range having upper and lower values including about 0.370 inches, 0.375 inches, 0.380 inches, 0.385 inches, 0.390 inches, 0.395 inches, 0.400 inches, 0.405 inches, 0.410 inches, 0.415 inches, 0.420 inches, 0.425 inches, 0.430 inches, about 0.435 inches, or any value therebetween. For example, the second inner diameter 108 may be between about 0.405 inches and about 0.435 inches. In another example, the second inner diameter 108 may be between about 0.415 inches and about 0.425 inches. In yet another example, the second inner diameter 108 may be about 0.423 inches.

As shown in FIG. 1, a link 100 includes a body 110, the first resilient member 102, the second resilient member 106, and the third resilient member 112. The first resilient member 102 has a first inner diameter 104. The second resilient member 106 has a second inner diameter 108. The third resilient member 112 has a third inner diameter 114. In some embodiments, the third inner diameter 114 may be the same as the first inner diameter 104 and/or second inner diameter 108. In other embodiments, the third inner diameter 114 may be different from the first inner diameter 104 and/or second inner diameter 108. For example, in the depicted embodiment, the third inner diameter 114 is larger than the first inner diameter 104. In another example, the first inner diameter 104 may be larger than the third inner diameter 114. In yet another example, the third inner diameter 114 may be larger than the second inner diameter 108. In a further example, the second inner diameter 108 may be larger than the third inner diameter 114. The third inner diameter 114 is within a range having upper and lower values including about 0.370 inches, 0.375 inches, 0.380 inches, 0.385 inches, 0.390 inches, 0.395 inches, 0.400 inches, 0.405 inches, 0.410 inches, 0.415 inches, 0.420 inches, about 0.425 inches, or any value therebetween. For example, the third inner diameter 114 may be between about 0.385 inches and about 0.415 inches. In another example, the third inner diameter 114 may be between about 0.395 inches and about 0.405 inches. In yet another example, the third inner diameter 114 may be about 0.401 inches.

Figure 2:
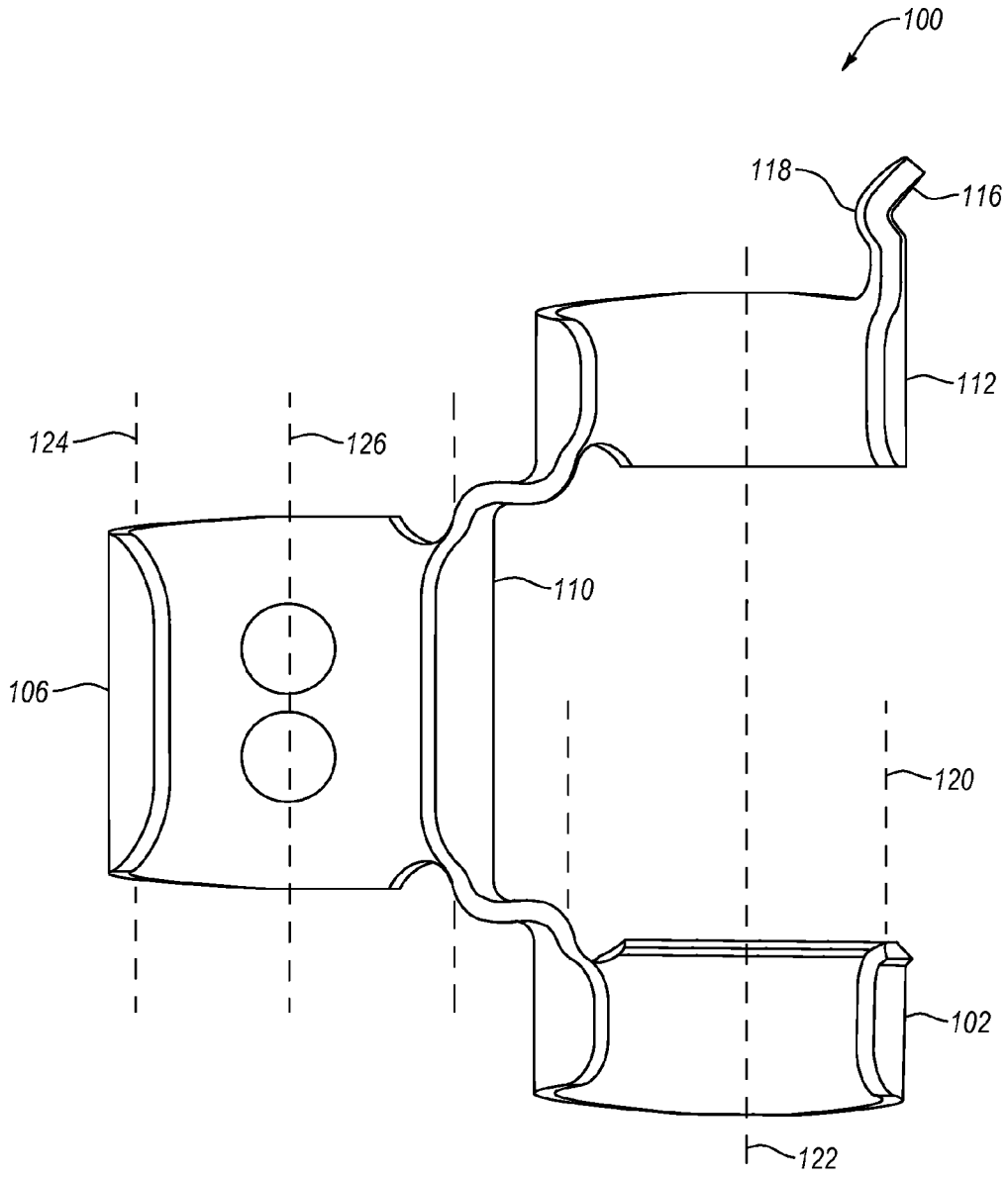
FIG. 2 is a front view of the link of FIG. 1.

As shown in FIG. 2, the link 100 includes a retention member (e.g., longitudinal tab 116) that restricts or, in some cases, substantially prevents movement of a cylindrical casing in a longitudinal direction relative to the link 100. The longitudinal tab 116 extends in a longitudinal direction from the third resilient member 112. In other embodiments, the retention member may extend from a body, first resilient member, or second resilient member. The longitudinal tab 116 includes a lateral protrusion 118. The first resilient member 102 defines a first cylindrical volume 120 through which a first longitudinal axis 122 extends. The second resilient member 106 defines a second cylindrical volume 124 through which a second longitudinal axis 126 extends. The lateral protrusion 118 extends toward the first longitudinal axis 122 and/or second longitudinal axis 126. For example, when the longitudinal tab 116 extends from the third resilient member 112, the lateral protrusion 118 extends into the first cylindrical volume 120 and toward the first longitudinal axis 122. In another example, when a longitudinal tab extends from a second resilient member, a lateral protrusion may extend into a second cylindrical volume and toward a second longitudinal axis.

Figure 3:
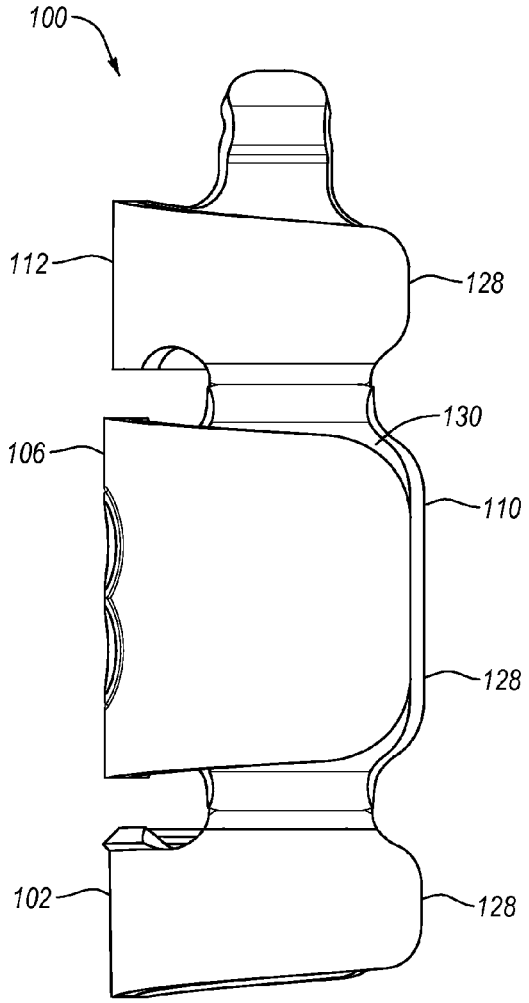
FIG. 3 is a left side view of the link of FIG. 1.

FIG. 3 is a side view of the link 100 of FIG. 1. The body 110, first resilient member 102, second resilient member 106, and third resilient member 112 are integrally formed with one another. For example, the body 110, first resilient member 102, second resilient member 106, and/or third resilient member 112 may be bent into shape from a single piece of malleable material. The body 110, first resilient member 102, second resilient member 106, and/or third resilient member 112 may include and/or be made of metal, such as a steel alloy, titanium alloy, aluminum alloy, superalloy, other alloy, or a combination thereof. In some embodiments, the steel alloy may include alloying elements such as a carbon, manganese, nickel, chromium, molybdenum, tungsten, vanadium, silicon, boron, lead, other appropriate alloying elements, or combinations thereof. In some embodiments, the titanium alloy may include alloying elements such as aluminum, vanadium, palladium, nickel, molybdenum, ruthenium, niobium, silicon, oxygen, iron, other appropriate alloying elements, or combinations thereof. In some embodiments, the aluminum alloy may include alloying elements such as silicon, iron, copper, manganese, magnesium, chromium, zinc, vanadium, titanium, bismuth, gallium, lead, zircon, other appropriate alloying elements, or combinations thereof. In some embodiments, the superalloy may include elements such as nickel, cobalt, iron, chromium, molybdenum, tungsten, tantalum, aluminum, titanium, zirconium, rhenium, yttrium, boron, carbon, another appropriate alloying element, or combinations thereof. In at least one embodiment, the body 110, first resilient member 102, second resilient member 106, and/or third resilient member 112 may include or be made of a cold rolled and annealed carbon steel, including, but not limited to steel 1050 to 1055 alloy. The steel may be heat treated. For example, the steel may be heat treated to a hardness rating of A70 to A74.

In some embodiments, the body 110, first resilient member 102, second resilient member 106, and/or third resilient member 112 may have thereon a coating. The coating may include a metal, a polymer, a wax, a plastic, or other material which may be deposited on the formed link 100 with a total weight of about 5 mg with a tolerance of about 2 mg. For example, the link 100 may have a wax coating of about 5 mg total coating weight deposited thereon.

The body 110 is a continuous piece of material that connects the first resilient member 102, the second resilient member 106, and the third resilient member 112. The body 110 has a plurality of curved portions 128. The curved portions 128 are located on the body 110 such that the curved portions 128 are longitudinally aligned with the first resilient member 102, second resilient member 106, and third resilient member 112. The curved portions 128 of the body 110 extend in a direction substantially opposing the first resilient member 102, second resilient member 106, and third resilient member 112. The first resilient member, second resilient member, or third resilient member may extend in an arcuate path from the body in a clockwise direction and the curved portion of the body may extend in an arcuate path in a counterclockwise direction. In another example, the first resilient member, second resilient member, or third resilient member may extend in an arcuate path from the body in a counterclockwise direction and the curved portion of the body may extend in an arcuate path in a clockwise direction.

The curved portion 128 of the body 110 has an inner radial surface 130 that substantially opposes an inner radial surface 130 of the first resilient member 102, second resilient member 106, or third resilient member 112. In the depicted embodiment in FIG. 3, an inner radial surface 130 is substantially continuous between the first resilient member 102, a portion of the body 110, and a curved portion 128 of the body 110. Another inner radial surface 130 is substantially continuous between the second resilient member 106, a portion of the body 110, and a curved portion 128 of the body 110. Yet another inner radial surface 130 is substantially continuous between the third resilient member 112, a portion of the body 110, and a curved portion 128 of the body 110. In other embodiments, a first resilient member, second resilient member, or third resilient member and a curved portion may form a substantially continuous arcuate inner radial surface with one or more radii of curvature. For example, an inner radial surface may be substantially continuous and arcuate while having a decreasing radius of curvature (i.e., a spiral).

Figure 4:
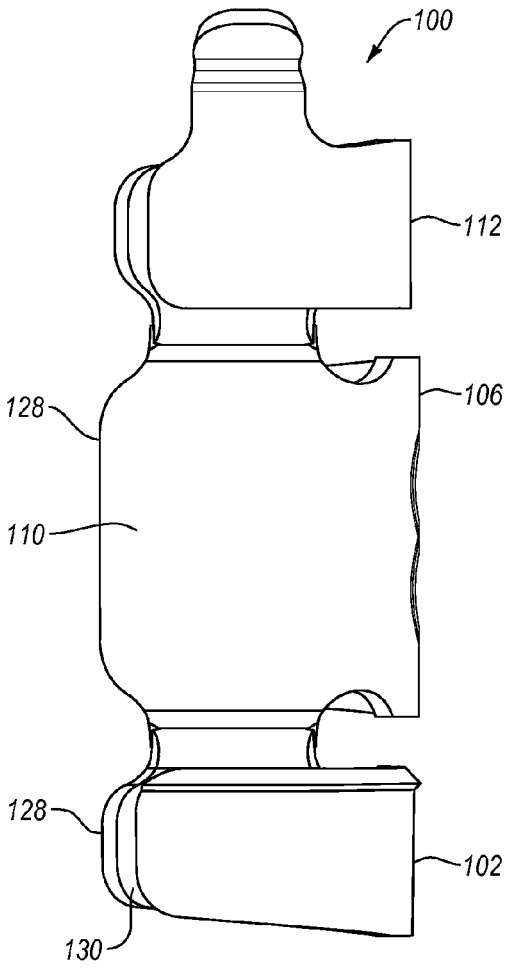
FIG. 4 is a right side view of the link of FIG. 1.

FIG. 4 shows a side view of the link 100 from the opposite side as the view in FIG. 3. The body 110 includes a curved portion 128 that extends in an opposite direction as a second resilient member 106. The body 110 extends longitudinally such that at least a portion is longitudinally aligned with the first resilient member 102 and/or the third resilient member 112. The first resilient member 102 substantially opposes a curved portion 128 of the body 110 and the first resilient member 102 and opposed curved portion 128 form an inner radial surface 130.

Figure 5:
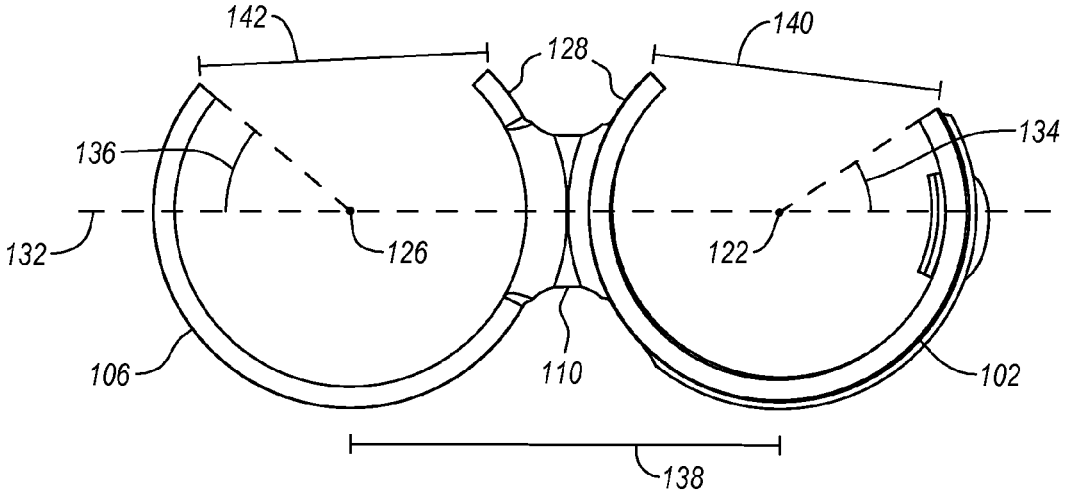
FIG. 5 is a top view of the link of FIG. 1.

FIG. 5 is a top view of the link 100 described herein. The first resilient member 102 extends from the body 110 in an arcuate path. The arcuate path of the first resilient member 102 defines a first plane. The first plane has a first longitudinal axis 122 extending perpendicular to the plane and parallel to the body 110. The second resilient member 106 extends from the body 110 in an arcuate path. The arcuate path of the second resilient member 106 defines a second plane. The second plane has a second longitudinal axis 126 extending perpendicular to the plane and parallel to the body 110. The first longitudinal axis 122 and second longitudinal axis 126 are parallel to one another.

The first longitudinal axis 122 and second longitudinal axis 126 lie within a plane 132. As shown in FIG. 5, the plane 132 passes through the first longitudinal axis 122 and the second longitudinal axis 126. In the top view of the link 100, the plane 132 is a line extending laterally through the first longitudinal axis 122 and the second longitudinal axis 126. The first resilient member 102 extends in an arcuate path beyond the plane 132 and a line including an end of the first resilient member 102 and the first longitudinal axis 122 may form a first end angle 134. The first end angle 134 has a value within a range having upper and lower values including about 60°, 62°, 64°, 66°, 68°, 70°, 72°, about 74°, or any value therebetween. For example, the first end angle 134 may have a value between about 64° and about 70°. In another example, the first end angle 134 may be about 66.6°. A line including an end of the second resilient member 106 and the second longitudinal axis 126 may intersect the plane 132 and define a second end angle 136. The second end angle 136 may have a value the same as or different from the first end angle 134. The second end angle 136 may be greater than the first end angle 134. The second end angle 136 has a value within a range having upper and lower values including about 60°, 62°, 64°, 66°, 68°, 70°, 72°, about 74°, or any value therebetween. For example, the second end angle 136 may have a value between about 64° and about 70°. In another example, the second end angle 136 may be about 66.8°.

The link 100 has a curved portion 128 of the body 110 that extends in a substantially opposite direction of the first resilient member 102. An end of the curved portion 128 and the end of the first resilient member 102 defines a first opening 140 that has a width. The width of the first opening 140 increases when the link 100 is elastically deformed to contain a casing (as will be described in relation to FIGS. 8-11). The first opening 140 has an initial width in the absence of applied forces. The first opening 140 has an initial width in a range having upper and lower values including about 0.230 inches, 0.235 inches, 0.240 inches, 0.245 inches, 0.250 inches, 0.255 inches, about 0.260 inches, or any value therebetween. For example, the initial width of the first opening 140 may between about 0.235 inches and about 0.250 inches. In another example, the initial width of the first opening 140 may be about 0.245 inches. The initial width increases as the first resilient member 102 is elastically deformed to apply a force to a casing or other object in contact with an inner radial surface of the first resilient member 102.

The link 100 has a curved portion 128 of the body 110 that extends in a substantially opposite direction of the second resilient member 106. An end of the curved portion 128 and the end of the second resilient member 106 defines a second opening 142 that has a width. The width of the second opening 142 may increase when the link 100 is elastically deformed to contain a casing (as will be described in relation to FIGS. 8-11). The second opening 142 has an initial width in the absence of applied forces. In some embodiments, the initial width of the second opening 142 may the same as the initial width of the first opening 140. In other embodiments, the initial width of the second opening 142 may be less than the initial width of the first opening 140. The second opening 142 has an initial width in a range having upper and lower values including 0.220 inches, 0.225 inches, 0.230 inches, 0.235 inches, 0.240 inches, 0.245 inches, 0.250 inches, 0.255 inches, 0.260 inches, or any value therebetween. For example, the initial width of the second opening 142 may be between 0.220 inches and 0.240 inches. In another example, the initial width of the second opening 142 may be about 0.233 inches. The initial width increases as the second resilient member 106 is elastically deformed and a force is applied to a casing or other object in contact with an inner radial surface of the second resilient member 106.

Figure 6:
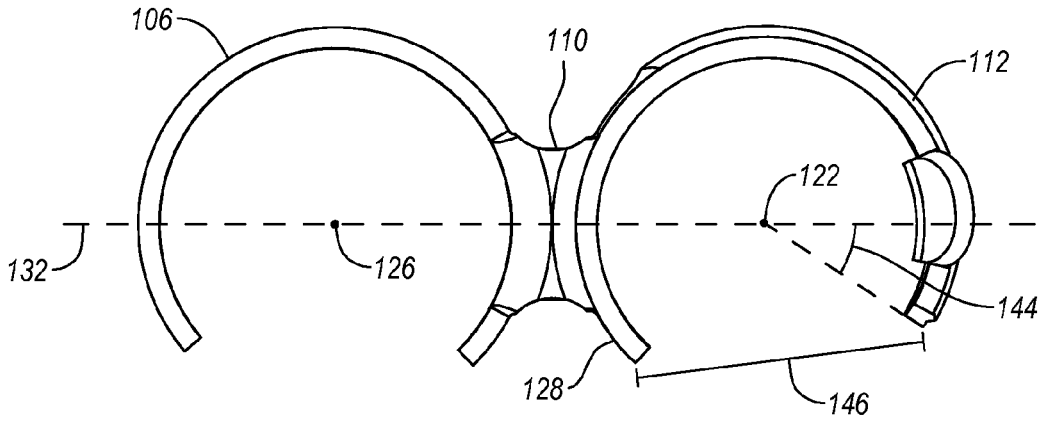
FIG. 6 is a bottom view of the link of FIG. 1.

FIG. 6 is a bottom view of the link 100. The third resilient member 112 extends from the body 110 in an arcuate path. The arcuate path of the third resilient member 112 defines a third plane that is substantially parallel to the first plane described in relation to FIG. 5. The third plane and first plane share a first longitudinal axis 122 extending perpendicular to the plane and parallel to the body 110. The second resilient member 106 extends from the body 110 in an arcuate path. The arcuate path of the second resilient member 106 defines a second plane. The second plane has a second longitudinal axis 126 extending perpendicular to the plane and parallel to the body 110. The first longitudinal axis 122 and second longitudinal axis 126 are parallel to one another. In other embodiments, the first longitudinal axis and second longitudinal axis may be oriented at an angle relative to one another.

The first longitudinal axis 122 and second longitudinal axis 126 lie within a plane 132. As shown in FIG. 6, the plane 132 passes through the first longitudinal axis 122 and the second longitudinal axis 126. In the bottom view of the link 100, the plane 132 is a line extending laterally through the first longitudinal axis 122 and the second longitudinal axis 126. The third resilient member 112 extends in an arcuate path beyond the plane 132 and a line includes an end of the third resilient member 112 and the first longitudinal axis 122 forms a third end angle 144. The third end angle 144 has a value within a range having upper and lower values including about 60°, 62°, 64°, 66°, 68°, 70°, 72°, about 74°, or any value therebetween. For example, the third end angle 144 may have a value between about 64° and about 70°. In another example, the third end angle 144 may be about 66.6°.

The link 100 has a curved portion 128 of the body 110 that extends in a substantially opposite direction of the third resilient member 112. An end of the curved portion 128 and the end of the third resilient member 112 defines a third opening 146 that has a width. The width of the third opening 146 increases when the link 100 is elastically deformed to contain a casing (as will be described in relation to FIGS. 8-11). The third opening 146 may have an initial width in the absence of applied forces. The third opening 146 has an initial width in a range having upper and lower values including about 0.240 inches, 0.245 inches, 0.250 inches, 0.255 inches, 0.260 inches, about 0.265 inches, or any value therebetween. For example, the initial width of the third opening 146 may between about 0.245 inches and about 0.255 inches. In another example, the initial width of the third opening 146 may be about 0.253 inches. The initial width increases as the third resilient member 112 is elastically deformed to apply a force to a casing or other object in contact with an inner radial surface of the third resilient member 112.

Figure 7:
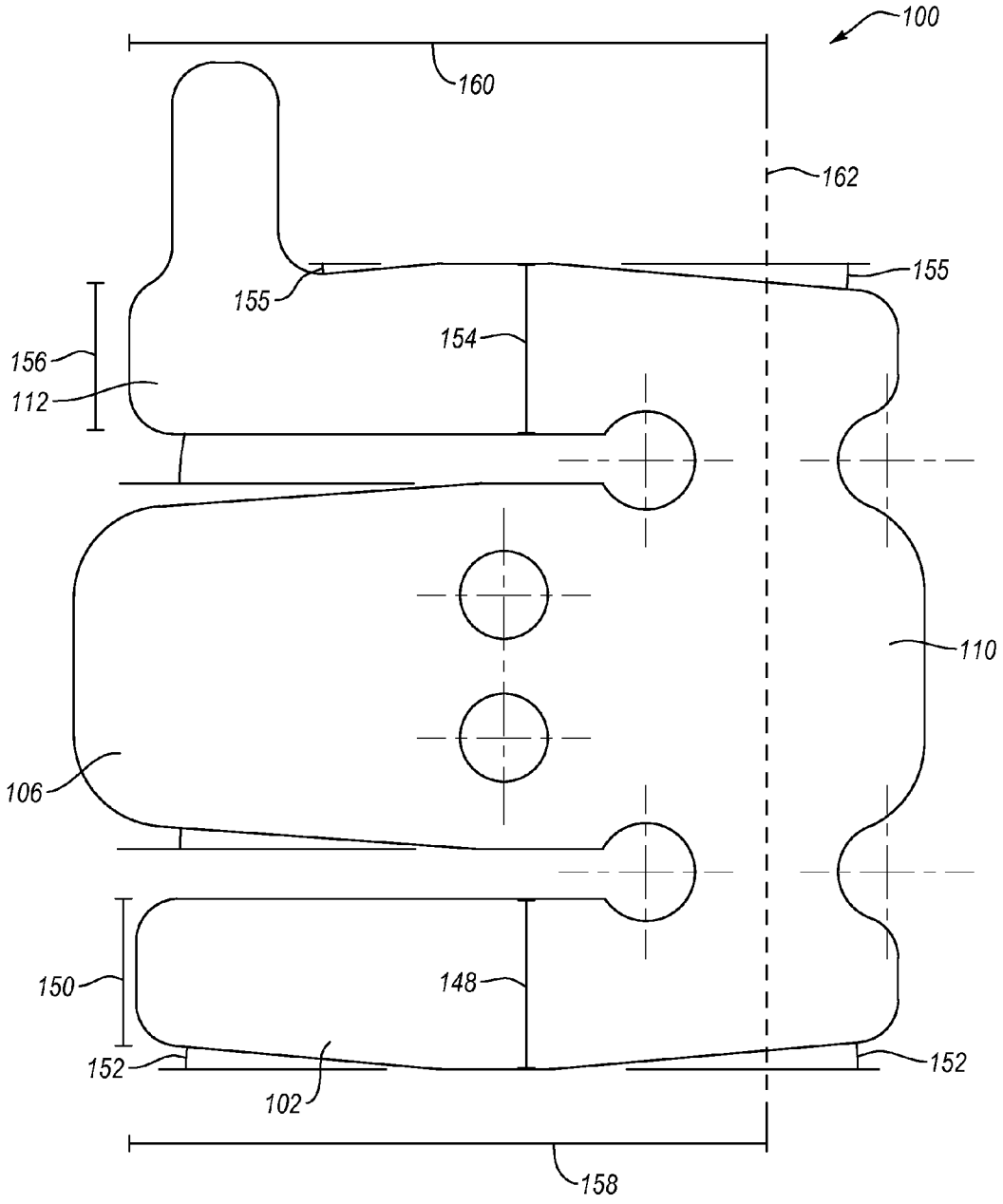
FIG. 7 is a front view of a blank of a link that may be formed into the link of FIG. 1.

A body, first resilient member, second resilient member, and/or third resilient member may be integrally formed in a single piece of material in a sheet. As shown in FIG. 7, the body 110, first resilient member 102, second resilient member 106, and/or third resilient member 112 are stamped in a single piece of material to form a blank of the link 100. The first resilient member 102, second resilient member 106, and/or third resilient member 112 may be bent, moved, or otherwise formed relative to the body 110 to the shape and dimensions depicted and/or described in relation to FIGS. 1 through 6. The first resilient member 102 has a first width 148 and a second width 150. The first width 148 of the first resilient member 102 is proximal and/or nearer to the body 110 than the second width 150. The second width 150 of the first resilient member is distal from the body 110. The first resilient member 102 may include a taper 152 such that a first width 148 of the first resilient member 102 is greater than the second width 150. In the depicted embodiment, the first width 148 has a value between about 0.240 inches and about 0.250 inches. The taper 152 of the first resilient member 102 has a value of between about 4° and about 6°. In at least one particular embodiment, the taper 152 may have a value of about 5°. The first resilient member 102 includes a taper 152 that extends toward the body 710.

The third resilient member 112 has one or more dimensions similar to or the same as the first resilient member 102. For example, the third resilient member 112 has a first width 154 and a second width 156. The first width 154 is proximal or closer to the body 110 than the second width 156. The third resilient member 112 has a taper 155, such that the first width 154 may be greater than the second width 156 of the third resilient member 112. The taper 155 of the third resilient member 112 has a value of between about 4° and about 6°. In at least one particular embodiment, the taper 155 may have a value of about 5°. In some embodiments, the first resilient member 102 includes a taper 152 that extends toward the body 110.

The blank of link 100 depicted in FIG. 7 has a uniform thickness prior to bending into the final form depicted in FIGS. 1 through 6. The blank of link 100 has a thickness in a range having upper and lower values including about 0.024 inches, 0.025 inches, 0.026 inches, 0.027 inches, 0.028 inches, 0.029 inches, 0.030 inches, 0.031 inches, 0.032 inches, or any value therebetween. For example, the thickness may be between about 0.024 inches and 0.030 inches. In another example, the thickness may be between 0.025 inches and 0.029 inches. In yet other embodiments, the thickness may be between 0.026 inches and 0.028 inches. The link 100 may have non-uniform thickness in other embodiments. For example, a link may have material that is thinner or thicker in certain locations to allow more or less flexibility. In some embodiments, a link may have less material at a joint between a resilient arm and the body to allow more flexibility of the resilient arm relative to the body. In other embodiments, the link may have a thickness of material along a length of a resilient arm that decreases with increasing distance from the body. Such an embodiment may allow for the tips of the resilient arms to be more flexible while the body and remainder of the resilient arms are less flexible.

Figure 8:
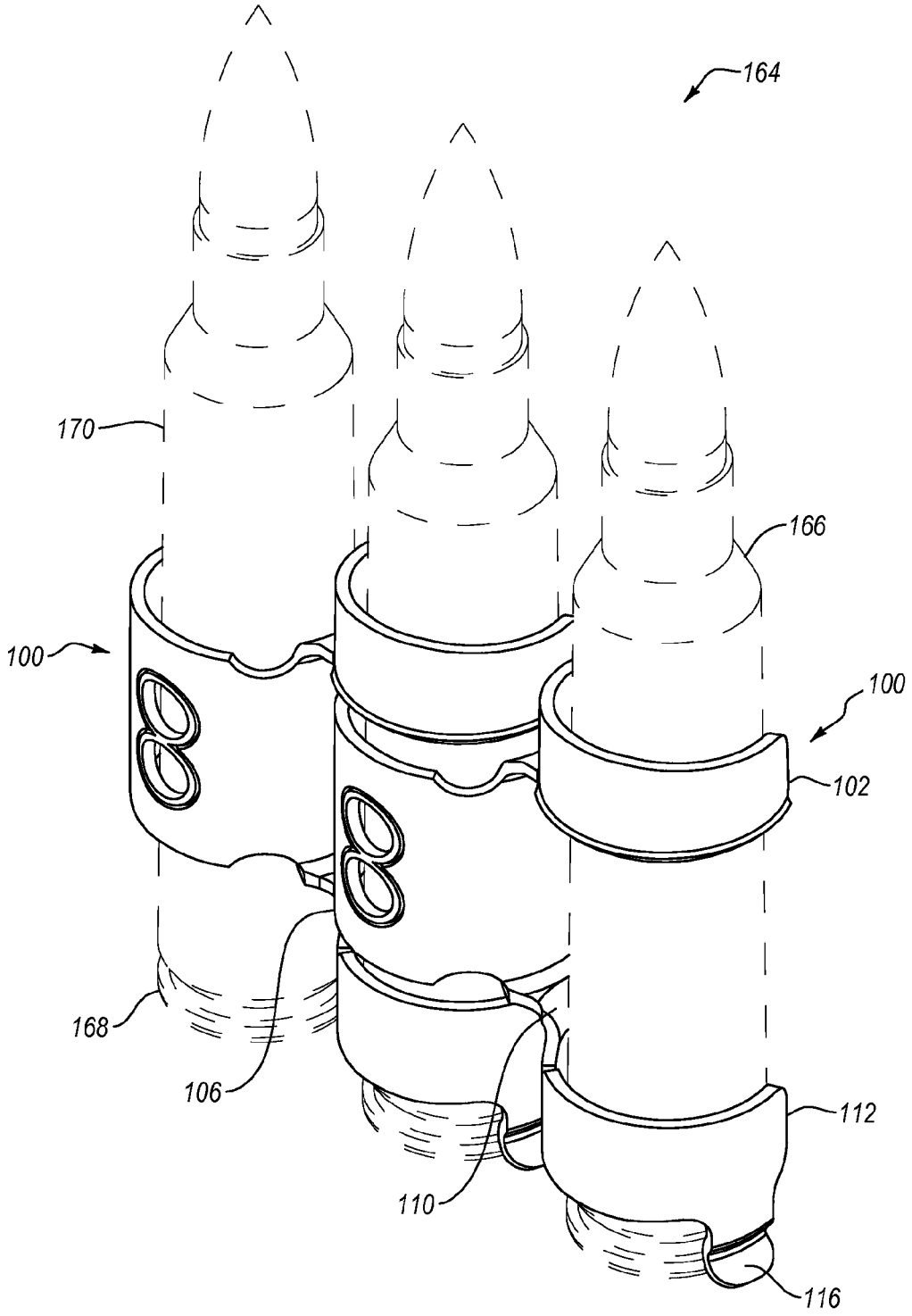
FIG. 8 is a perspective view of a system including a plurality of the links of FIG. 1, according to one or more embodiments disclosed herein.

FIGS. 8 through 11 depict one or more embodiments of a system including a plurality of links such as the link 100 depicted in FIGS. 1 through 6. FIG. 8 is a perspective view of a system 164 that includes a plurality of links 100 and a plurality of rounds 166 of ammunition. The rounds 166 may be 6.8 millimeter SPC ammunition, 7.62×39 millimeter ammunition, or other ammunition sharing a similar casing diameter and taper from a base 168 to a neck 170, where the base 168 has a large diameter than the neck 170. The system 164 allows a plurality of links 100 and rounds 166 to form a continuous belt or clip of ammunition by using a round 166 to provide a connection between each pair of links 100. Similarly, a link 100 forms a connection between each pair of rounds 166, as shown in FIG. 8. A round 166 is engaged by a first resilient member 102 of a link 100 and a third resilient member 112 of the same link 100. The same round 166 is engaged by a second resilient member 106 of another link 100. A link 100 engages a round 166 with a first resilient member 102 and a third resilient member 112. The same link 100 engages another round 166 with a second resilient member 106. In such a manner, a belt is formed by the system 164.

Figure 9:
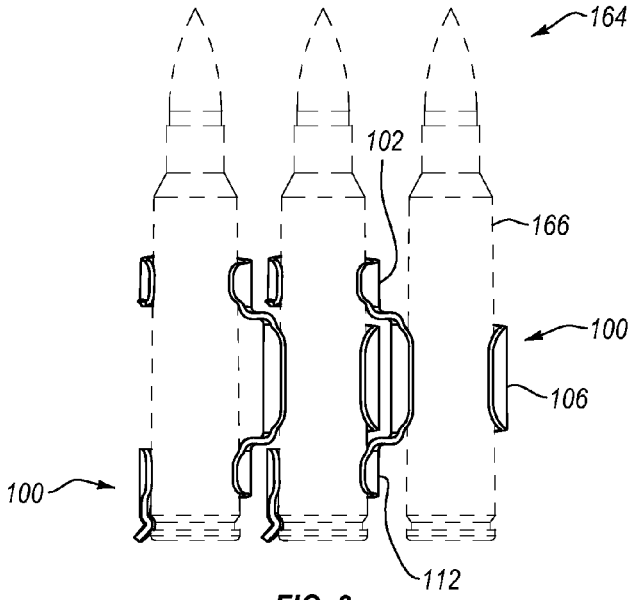
FIG. 9 is a front view of the system of FIG. 8.

FIG. 9 is a front view of the system 164 that includes a plurality of links 100 and a plurality of rounds 166 interconnected to form a belt. The link 100 engages a round 166 with a first resilient member 102 and a third resilient member 112. The first resilient member 102 and the third resilient member 112 may each engage with the round 166 such at one or both of the first resilient member 102 and the third resilient member 112 apply a compressive force to the round 166. The compressive force may provide an associated friction force between the round 166 and the first resilient member 102 and/or the third resilient member 112. The link 100 may engage with a round 166 with a second resilient member 106 such that the second resilient member 106 does not apply a compressive force to the round 166, and rather has an inner diameter (such as second inner diameter 108 described in relation to FIG. 1) that is greater than a diameter of the round 166 such that the link 100 and round 166 may move (e.g., rotate) relative to one another with substantially no resistance therebetween.

In some embodiments, one of the plurality of rounds 166 may be removed from the system 164 by applying a force to one of the plurality of rounds 166 perpendicular to the compressive forces applied by the link 100. For example, one of the plurality of rounds 166 may be removed from the system 164 by applying a force to one of the plurality of rounds 166 between about 8.5 pounds and about 18 pounds. In some embodiments, the system 164 comprising six links 100 and five rounds 166 may be capable of withstanding a tensile load of about 55 pounds without separation.

Figure 10:
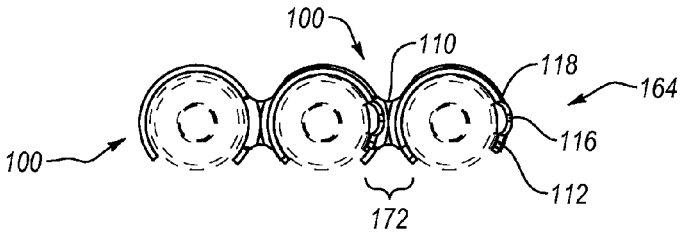
FIG. 10 is a top view of the system of FIG. 8.

FIG. 10 is a bottom view of the system 164 that includes a plurality of links 100 and a plurality of rounds 166 interconnected to form a belt. The bottom view shows a third resilient member 112 of the link 100 that includes a longitudinal tab 116 with a lateral protrusion 118 therein. The lateral protrusion 118 engages with the round 166 to limit, or in some cases prevent, longitudinal movement of the round 166 relative to the link 100. A body 110 of the link 100 provides a space 172 between each round 166. The space 172 provides enough room for a link 100 to rotate about a round 166 relative to another link 100 without the first resilient member 102 and/or third resilient member 112 of a link 100 interfering with the first resilient member 102 and/or third resilient member 112 of another link 100.

Figure 11:
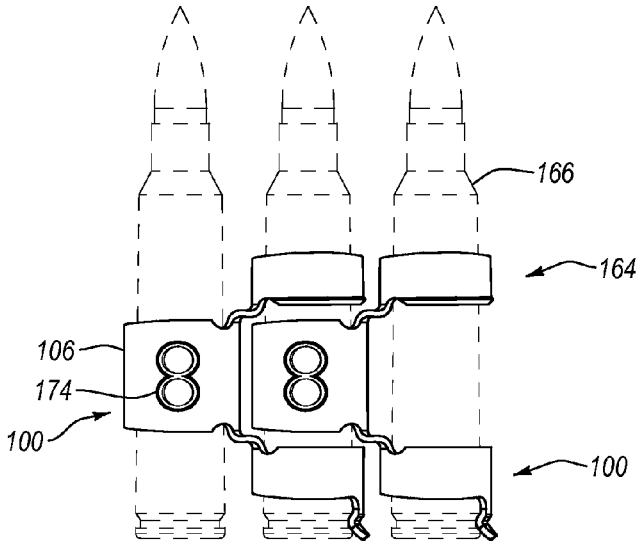
FIG. 11 is a back view of the system of FIG. 8.

FIG. 11 is a back view of the system 164 that includes a plurality of links 100 and a plurality of rounds 166 interconnected to form a belt. The link 100 includes one or more identification features 174 to allow visual and/or tactile identification of a link 100. In a combat situation, visibility may be limited due to lack of light or particulates in the atmosphere (i.e., smoke, sand, dust, etc.). Additionally, different types and/or dimensions of ammunition may be used in a single combat situation. Tactile identification of a link 100 allows a user to identify the associated ammunition round 166 by feel, as well, aiding the loading of appropriate ammunition for a firearm. The link 100 includes an identification feature 174 having a pair of holes drilled through the second resilient member 106 to allow precise identification of the link 100.

The links 100 may be configured to substantially retain a cylindrical casing having an outer diameter between about 0.400 inches and about 0.420 inches. In another example, the links 100 may be configured to substantially retain a cylindrical casing having an average outer diameter of about 0.410 inches.

In at least one embodiment, the link 100 may be configured to substantially retain a round of 6.8 mm SPC Remington rifle ammunition. In another embodiment, the link 100 may be configured to substantially retain a round of 7.62×39 mm rifle ammunition. Advantageously, in yet another embodiment, links 100 may be configured to substantially retain a round of 6.8 mm SPC Remington rifle ammunition or 7.62×39 mm rifle ammunition. The link 100 or a plurality of links 100 and the ranges, measurements, and parameters discussed herein are also highly useful because the links 100 can reliably hold both tapered and non-tapered ammunition. These and other features discussed herein make the links 100 a valuable contribution to the art.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A link comprising:

a body;

a first resilient member extending laterally from the body in a first direction; the first resilient member extending in a first arc, the first arc being normal to a first longitudinal axis and defining a first circumference around which the first resilient member extends more than halfway;

a second resilient member extending laterally from the body in a second direction, the second direction substantially opposite the first direction, the second resilient member extending in a second arc, the second arc being normal to a second longitudinal axis and defining a second circumference around which the second resilient member extends more than halfway, the second longitudinal axis being parallel to the first longitudinal axis; and a retention member extending in a third direction, the third direction being substantially perpendicular to both the first direction and second direction, wherein the first arc has a first diameter between about 0.390 inches and about 0.425 inches and the second arc has a second diameter between about 0.400 inches and about 0.435 inches, and wherein a thickness of the link is in a range between 0.024 inches and 0.032 inches.

2. The link of claim 1, wherein the first resilient member extends more than 60% around the first circumference.

3. The link of claim 1, wherein the second resilient member extends more than 70% around the second circumference.

4. The link of claim 1, further comprising a third resilient member extending laterally from the body in the first direction, the third resilient member extending in a third arc, the third arc defining a third circumference around which the third resilient member extends more than halfway, and wherein the third arc is normal to the second longitudinal axis.

5. The link of claim 4, the third arc having a third diameter between about 0.390 inches and about 0.425 inches.

6. The link of claim 4, the third arc having a third diameter greater than the first diameter.

7. The link of claim 1, wherein the second diameter is greater than the first diameter.

8. The link of claim 1, further comprising a third resilient member extending laterally from the body in the first direction, the third resilient member extending in a third arc, the third arc defining a third circumference around which the third resilient member extends more than halfway, and wherein the third arc is normal to the second longitudinal axis, the first arc has a first diameter between 0.390 inches and 0.425 inches, the second arc has a second diameter between 0.400 inches and 0.435 inches, and the third arc has a third diameter between 0.390 inches and 0.425 inches.

9. A link, the link comprising:

a body;

a first resilient member extending laterally from the body in a first direction; the first resilient member extending in a first arc, the first arc being normal to a first longitudinal axis and defining a first circumference around which the first resilient member extends more than halfway, the first arc defining a first opening having an initial width between 0.235 inches and 0.250 inches;

a second resilient member extending laterally from the body in a second direction, the second direction substantially opposite the first direction, the second resilient member extending in a second arc, the second arc being normal to a second longitudinal axis and defining a second circumference around which the second resilient member extends more than halfway, the second longitudinal axis being parallel to the first longitudinal axis, the second arc defining a second opening having an initial width between 0.220 inches and 0.240 inches;

a third resilient member extending laterally from the body in the first direction, the third resilient member extending in a third arc, the third arc defining a third circumference around which the third resilient member extends more than halfway the third arc defining a third opening having an initial width between 0.245 inches and 0.255 inches, and wherein the third arc is normal to the second longitudinal axis; and a retention member extending in a third direction, the third direction being substantially perpendicular to both the first direction and second direction, wherein the first arc has a first diameter between 0.390 inches and 0.425 inches, the second arc has a second diameter between 0.400 inches and 0.435 inches, and the third arc has a third diameter between 0.390 inches and 0.425 inches.

10. The link of claim 9, wherein the first resilient member has a first end angle between 64° and 70°.

11. The link of claim 9, wherein the second resilient member has a second end angle between 64° and 70°.

12. A linking system comprising:

a plurality of links, each of the links of the plurality of links having:

a body, a first resilient member extending laterally from the body in a first direction; the first resilient member extending in a first arc, the first arc being normal to a first longitudinal axis and defining a first circumference around which the first resilient member extends more than halfway, a second resilient member extending laterally from the body in a second direction, the second direction substantially opposite the first direction, the second resilient member extending in a second arc, the second arc being normal to a second longitudinal axis and defining a second circumference around which the second resilient member extends more than halfway, the second longitudinal axis being parallel to the first longitudinal axis, a third resilient member extending laterally from the body in the first direction, the third resilient member extending in a third arc, the third arc defining a third circumference around which the third resilient member extends more than halfway, and wherein the third arc is normal to the second longitudinal axis, and a retention member extending in a third direction, the third direction being substantially perpendicular to both the first direction and second direction, wherein the first arc has a first diameter between about 0.390 inches and about 0.425 inches, the second arc has a second diameter between about 0.400 inches and about 0.435 inches, and the third arc has a third diameter between about 0.390 inches and about 0.425 inches; and one or more cylindrical casings, at least one of the one or more cylindrical casings having the first resilient member engaged around a majority of a circumference thereof and the second resilient member engaged around a majority of a circumference thereof, wherein the first resilient member applies a compressive force to the at least one of the one of more casings and the second resilient member applies no compressive force and the third resilient member of at each of the links of the plurality of links applies a second compressive force on one of the one or more cylindrical casings that is greater than the compressive force applied on one of the one or more cylindrical casings by the first resilient member.

13. The linking system of claim 12, wherein the third resilient member is engaged around a majority of a circumference of the at least one of the one or more casings and applies a compressive force to the at least one of the one of more casings.

14. A linking system comprising:

a plurality of links, each of the links of the plurality of links having:

a body, a first resilient member extending laterally from the body in a first direction; the first resilient member extending in a first arc, the first arc being normal to a first longitudinal axis and defining a first circumference around which the first resilient member extends more than halfway, a second resilient member extending laterally from the body in a second direction, the second direction substantially opposite the first direction, the second resilient member extending in a second arc, the second arc being normal to a second longitudinal axis and defining a second circumference around which the second resilient member extends more than halfway, the second longitudinal axis being parallel to the first longitudinal axis, and a retention member extending in a third direction, the third direction being substantially perpendicular to both the first direction and second direction, wherein the first arc has a first diameter between about 0.390 inches and about 0.425 inches and the second arc has a second diameter between about 0.400 inches and about 0.435 inches; and one or more cylindrical casings, at least one of the one or more cylindrical casings having a first resilient member engaged around a majority of a circumference thereof and a second resilient member engaged around a majority of a circumference thereof, wherein the first resilient member applies a compressive force to the at least one of the one of more casings and the second resilient member applies no compressive force, wherein each of the links of the plurality of links includes a plurality of apertures located through the second resilient member and configured to provide tactile identification of the second resilient member.

15. The linking system of claim 12, wherein the linking system is an ammunition linking system and the one or more cylindrical casings taper along a longitudinal axis.

16. The link of claim 9, wherein the link is made of steel alloy.

17. The link of claim 16, wherein the steel alloy is cold rolled and tempered to a T5 hardness.

18. The link of claim 1, wherein the thickness of the link is in a range between 0.025 inches and 0.029 inches.

19. The link of claim 9, wherein a thickness of the link is in a range between 0.024 inches and 0.032 inches.

20. The link of claim 9, wherein a thickness of the link is in a range between 0.026 inches and 0.028 inches.

21. The linking system of claim 12, wherein a thickness of each of the links of the plurality of links is in a range between 0.024 inches and 0.032 inches.

22. The linking system of claim 12, wherein each of the links of the plurality of links includes a plurality of apertures located through the second resilient member and configured to provide tactile identification of the second resilient member.

23. The linking system of claim 14, wherein a thickness of each of the links of the plurality of links is in a range between 0.024 inches and 0.032 inches.

24. The link of claim 1, wherein the link includes a plurality of apertures located through the second resilient member and configured to provide tactile identification of the second resilient member.

25. The link of claim 9, wherein the link includes a plurality of apertures located through the second resilient member and configured to provide tactile identification of the second resilient member.

26. The link of claim 1, wherein the thickness of the link is in a range between 0.026 inches and 0.028 inches.

27. The linking system of claim 12, wherein a thickness of each of the links is in a range between 0.026 inches and 0.028 inches.

28. The link of claim 1, wherein the thickness of the link is 0.027 inches.

29. The link of claim 9, wherein a thickness of the link is 0.027 inches.

30. The link of claim 9, wherein the first opening has an initial width between about 0.240 inches and about 0.245 inches, and the second opening has an initial width between about 0.225 inches and about 0.235 inches.

31. The link of claim 9, wherein the first opening has an initial width of about 0.245 inches, the second opening has an initial width of about 0.233 inches, and the third opening has an initial width of about 0.253 inches.

32. The linking system of claim 12, wherein the first arc defines a first opening having an initial width between about 0.240 inches and about 0.245 inches and the second arc defines a second opening having an initial width between about 0.225 inches and about 0.235 inches.

33. The linking system of claim 32, wherein the first opening has an initial width of about 0.245 inches, the second opening has an initial width of about 0.233 inches, and the third arc defines a third opening having an initial width of about 0.253 inches.

34. The link of claim 1, wherein the first diameter is between about 0.395 inches and about 0.410 inches and the second diameter is between about 0.415 inches and about 0.425 inches.

35. The link of claim 1, wherein the first diameter is about 0.399 inches and the second diameter is about 0.423 inches.

36. The link of claim 26, wherein the first diameter is between about 0.395 inches and about 0.410 inches and the second diameter is between about 0.415 inches and about 0.425 inches.

37. The link of claim 26, wherein the first diameter is about 0.399 inches and the second diameter is about 0.423 inches.

38. The link of claim 28, wherein the first diameter is between about 0.395 inches and about 0.410 inches and the second diameter is between about 0.415 inches and about 0.425 inches.

39. The link of claim 28, wherein the first diameter is about 0.399 inches and the second diameter is about 0.423 inches.

* * * * *